US010295133B2

(12) United States Patent
Chami et al.

(10) Patent No.: US 10,295,133 B2
(45) Date of Patent: May 21, 2019

(54) MODULAR SOLID STATE HIGH BAY LIGHTING FIXTURE

(71) Applicant: MaxLite, Inc., West Caldwell, NJ (US)

(72) Inventors: Aymen Chami, Hackettstown, NJ (US); Bryan Ortega, Kearny, NJ (US)

(73) Assignee: MAXLITE, INC., West Caldwell, NJ (US)

( * ) Notice: Subject to any disclaimer, the term of this patent is extended or adjusted under 35 U.S.C. 154(b) by 0 days.

(21) Appl. No.: 15/820,759

(22) Filed: Nov. 22, 2017

(65) Prior Publication Data

US 2018/0142850 A1 May 24, 2018

Related U.S. Application Data

(60) Provisional application No. 62/425,234, filed on Nov. 22, 2016.

(51) Int. Cl.

| | |
|---|---|
| ***F21S 8/04*** | (2006.01) |
| ***F21S 8/06*** | (2006.01) |
| ***F21V 7/00*** | (2006.01) |
| ***F21V 17/10*** | (2006.01) |
| ***F21V 23/00*** | (2015.01) |
| ***F21V 29/76*** | (2015.01) |
| ***F21Y 103/10*** | (2016.01) |
| ***F21Y 115/10*** | (2016.01) |

(52) U.S. Cl.

CPC ..... *F21S 8/046* (2013.01); *F21S 8/061* (2013.01); *F21V 7/005* (2013.01); *F21V 17/104* (2013.01); *F21V 23/009* (2013.01); *F21V 29/763* (2015.01); *F21Y 2103/10* (2016.08); *F21Y 2115/10* (2016.08)

(58) Field of Classification Search

None

See application file for complete search history.

(56) References Cited

U.S. PATENT DOCUMENTS

| | | | | |
|---|---|---|---|---|
| 2011/0235317 | A1* | 9/2011 | Verfuerth | F21V 7/005 362/217.05 |
| 2014/0292208 | A1* | 10/2014 | Chemel | H05B 33/0854 315/154 |
| 2015/0226407 | A1* | 8/2015 | Yang | F21V 14/02 362/249.01 |
| 2016/0102839 | A1* | 4/2016 | Barkhurst | F21S 2/005 362/247 |

* cited by examiner

*Primary Examiner* — Kristy A Haupt

(74) *Attorney, Agent, or Firm* — Budzyn IP Law, LLC

(57) ABSTRACT

A modular solid state high bay lighting fixture is provided herein which includes at least two lighting modules, each including a body configured to define an open channel along one face thereof. A plurality of solid state light generating elements are located in the open channels of the bodies, with a lens or diffuser at least partly overlying each of the open channels. Bottom and upper plates extend between the lighting modules with the upper plate being spaced from, and at least partially overlying, the bottom plate so that a chamber is formed therebetween. A pair of endcaps are provided on opposite ends of the lighting modules. Advantageously, the subject invention allows for a solid state lighting fixture to be prepared in modular form which allows for both width and length adjustment.

14 Claims, 20 Drawing Sheets

MODULAR SOLID STATE HIGH BAY LIGHTING FIXTURE

BACKGROUND OF THE INVENTION

High bay lighting fixtures are known in the prior art. In general, high bay lighting fixtures are used in high clearance areas, such as warehouses, manufacturing facilities, garages, etc., to provide well distributed and uniform light. Typically, high bay lighting fixtures utilize fluorescent or HID (high intensity discharge) lighting.

SUMMARY OF THE INVENTION

A modular solid state high bay lighting fixture is provided herein which includes at least two lighting modules, each including a body configured to define an open channel along one face thereof. A plurality of solid state light generating elements are located in the open channels of the bodies, with a lens or diffuser at least partly overlying each of the open channels. Bottom and upper plates extend between the lighting modules with the upper plate being spaced from, and at least partially overlying, the bottom plate so that a chamber is formed therebetween. A pair of endcaps are provided on opposite ends of the lighting modules. Advantageously, the subject invention allows for a solid state lighting fixture to be prepared in modular form which allows for both width and length adjustment.

These and other features of the subject invention will be better understood through a study of the following detailed description and accompanying drawings.

DETAILED DESCRIPTION OF THE INVENTION

Figure 1:
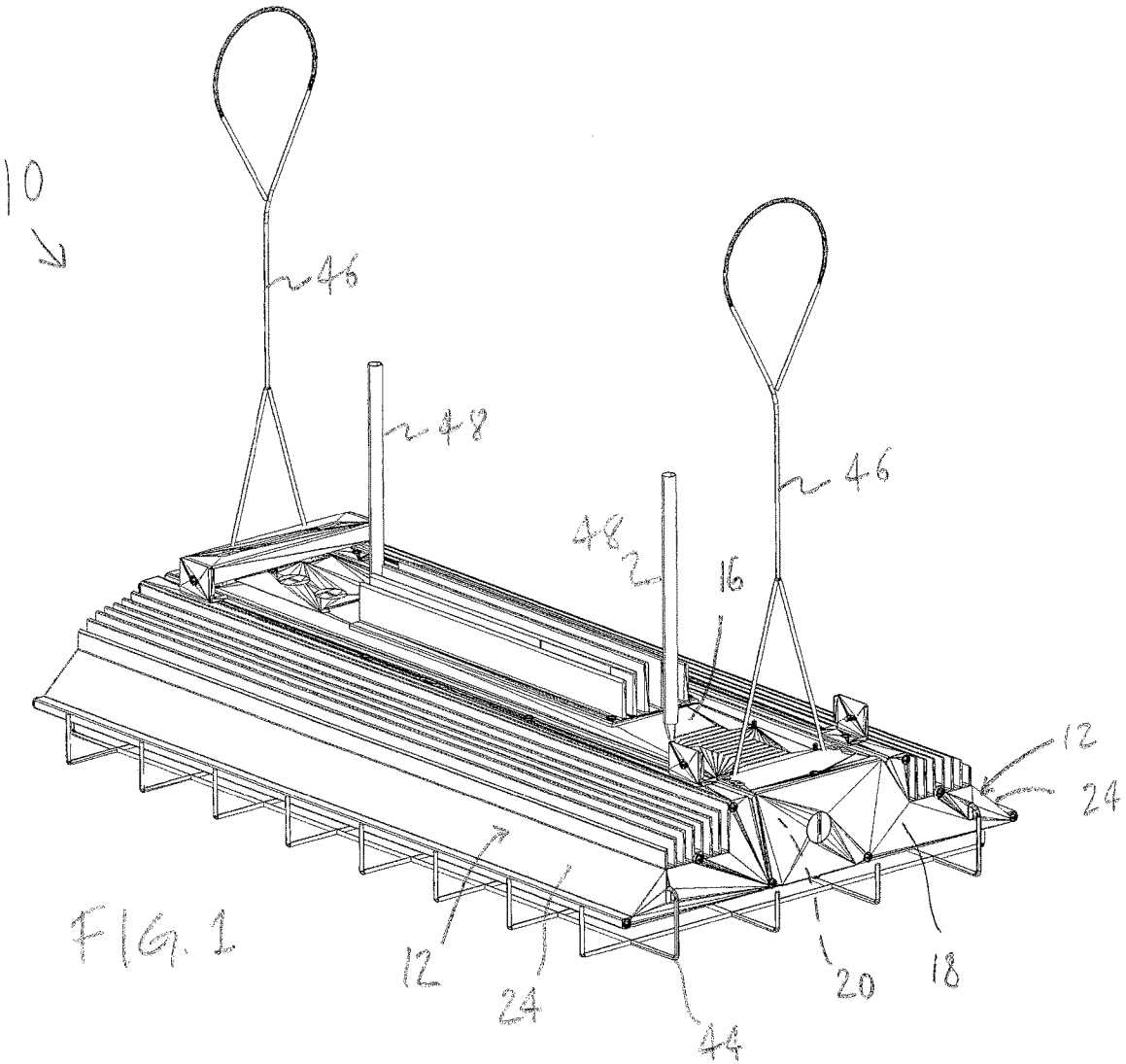
FIGS. 1 and 2 are perspective views of a lighting fixture formed in accordance with the subject invention.
Figure 2:
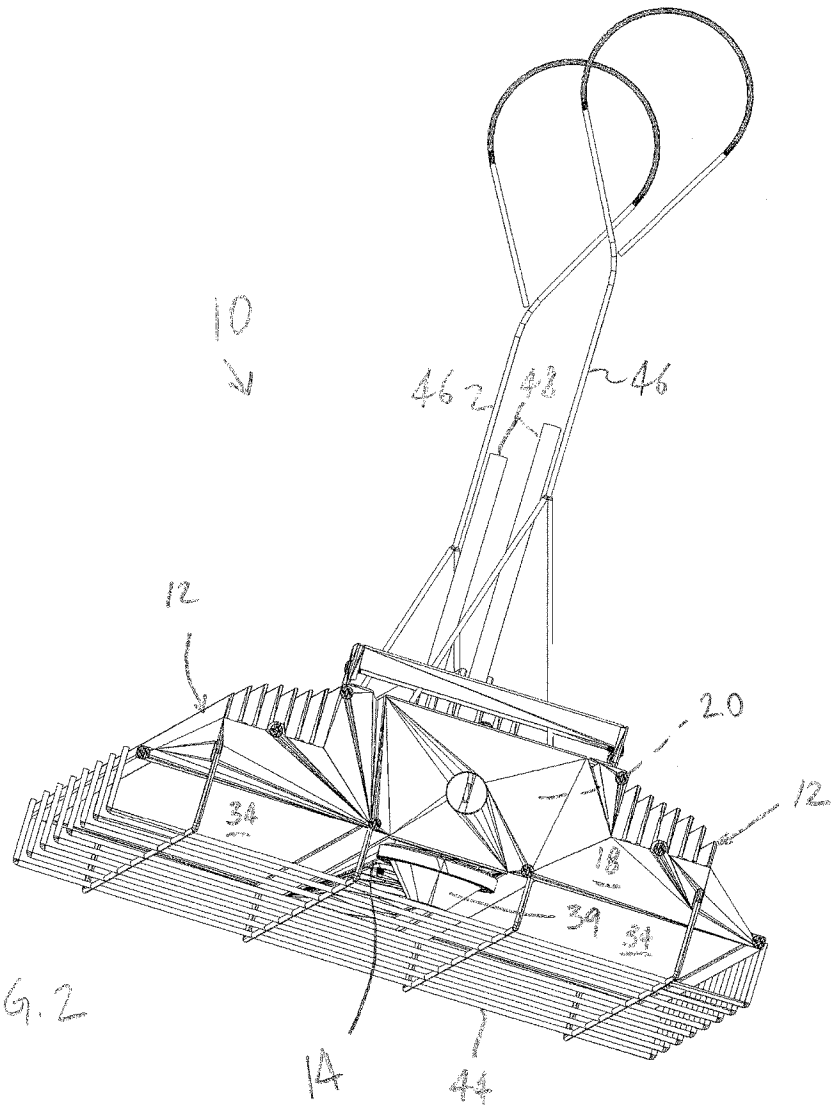

With reference to FIGS. 1-2, a solid state high bay lighting fixture 10 is shown useable in various applications, including high-mounting applications. The lighting fixture 10 may be cable mounted, pendant mounted or surface mounted.

The lighting fixture 10 generally includes at least two lighting modules 12, at least one bottom plate 14, at least one upper plate 16, and at least two endcaps 18. The lighting fixture 10 is formed from these components as a wholly-contained lighting fixture, including at least one chamber 20 for receiving a driver 22 and other electrical components as needed.

Figure 3:
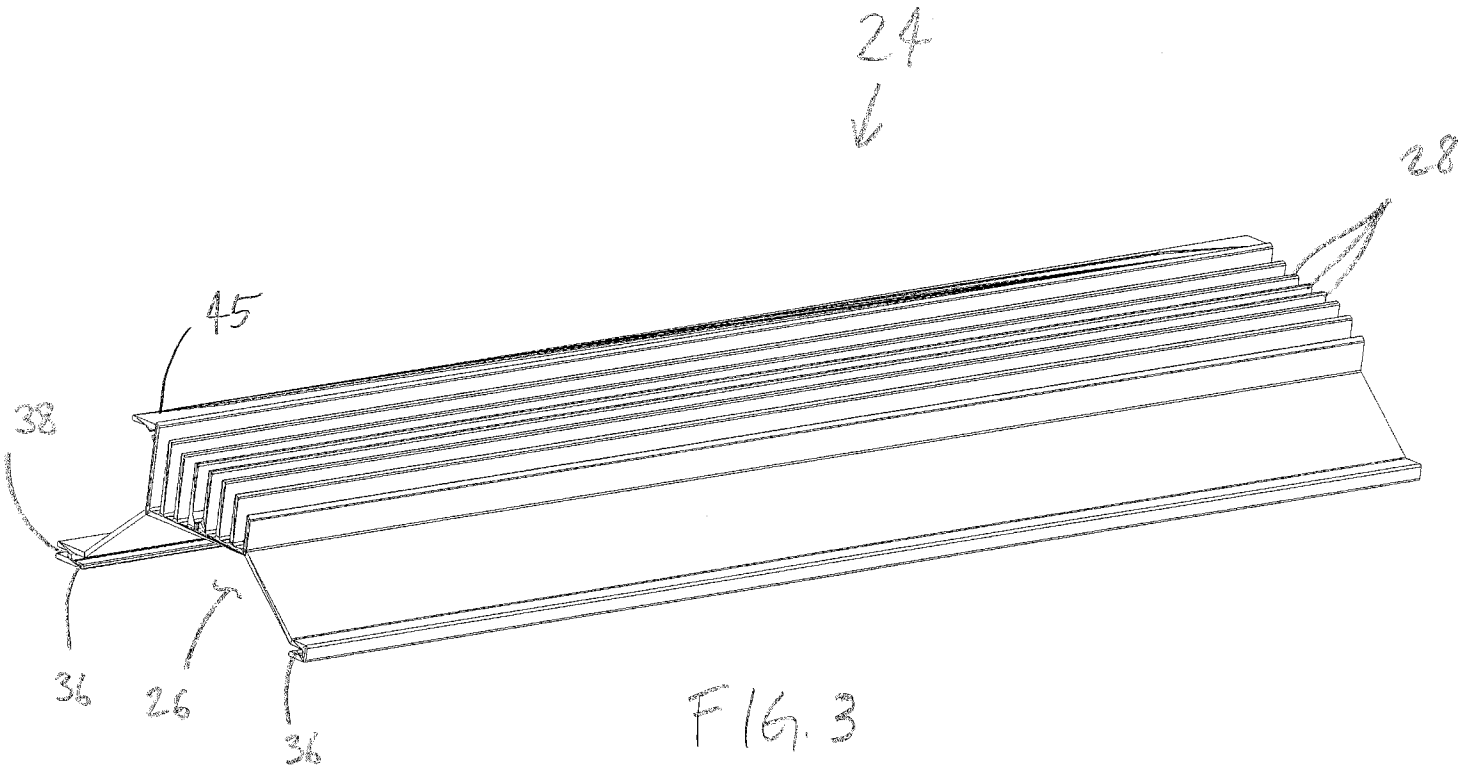
FIGS. 3-5 show a body in accordance with the subject invention.
Figure 4:
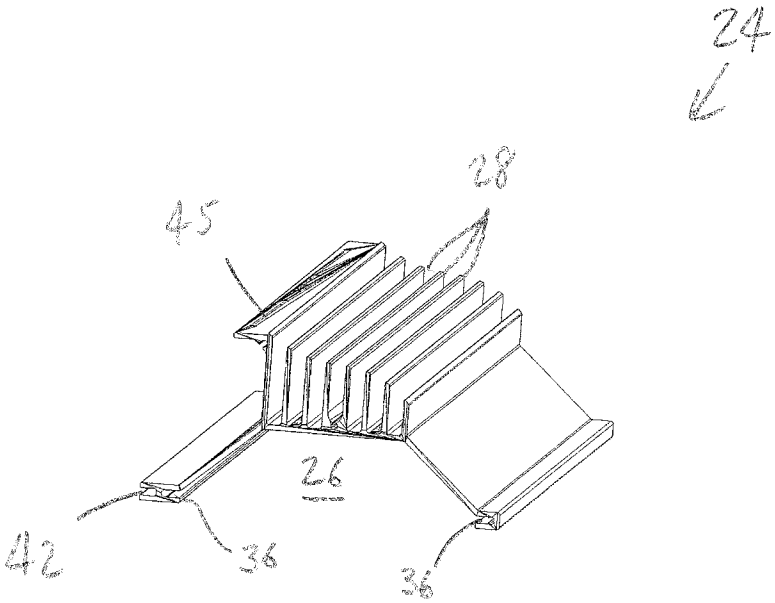
Figure 5:
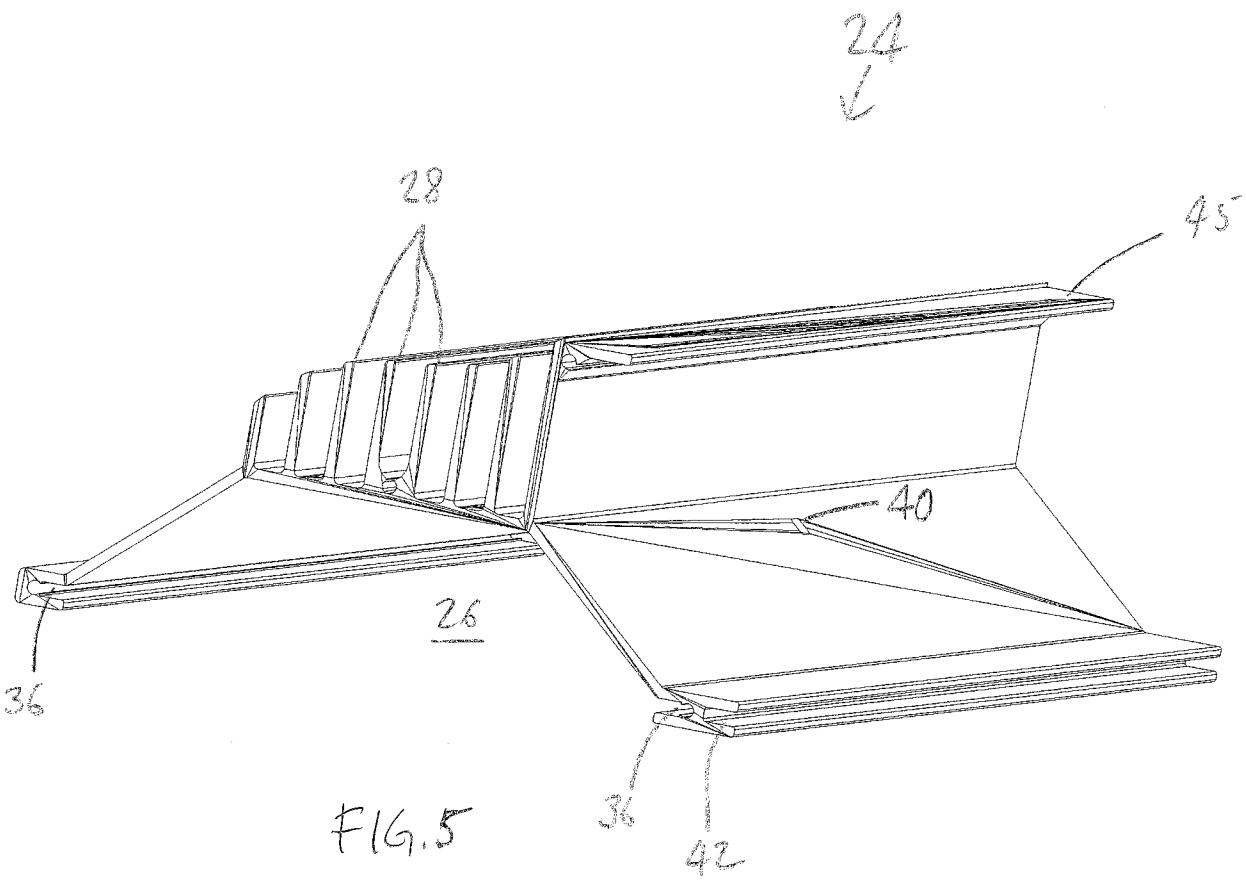
Figure 6:
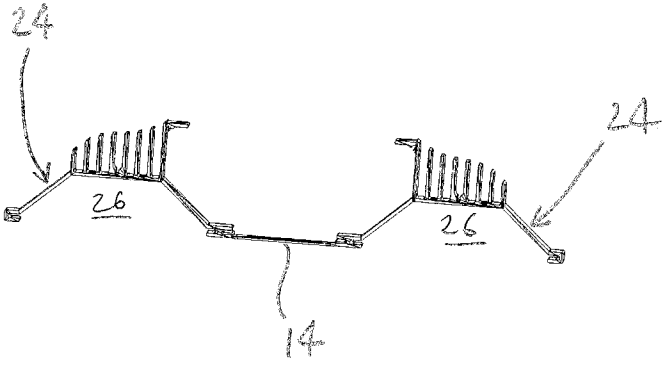
FIGS. 6-7 show a bottom plate extending between two bodies in accordance with the subject invention.

The lighting modules 12 each include a body 24 (FIGS. 3-5) configured to define an open channel 26 along one face thereof. The body 24 is preferably formed of a material having good heat conductivity properties, such as metal (e.g., aluminum). The body 24 may be formed with a generally constant cross-section, thus allowing for formation by extrusion. The body 24 may include a plurality of protruding fins 28. The fins 28 allow for improved heat dissipation. The fins 28 may be formed on the body 24 opposite the open channel 26. The body 24 may have the same cross-section for each of the lighting modules 12, but oriented differently relative to the lighting fixture 10, e.g., to present the fins 28 in symmetrical fashion as shown in the Figures.

Figure 11:
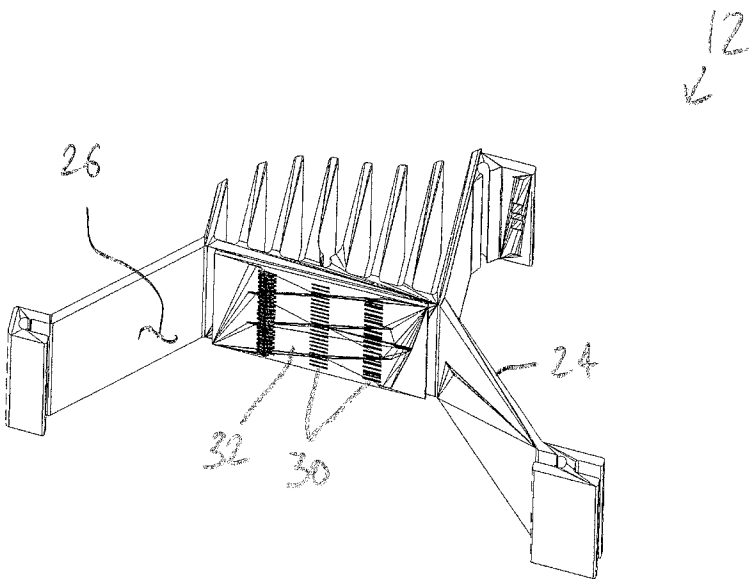
FIGS. 11-13 show solid state lighting elements mounted to a body in accordance with the subject invention.
Figure 12:
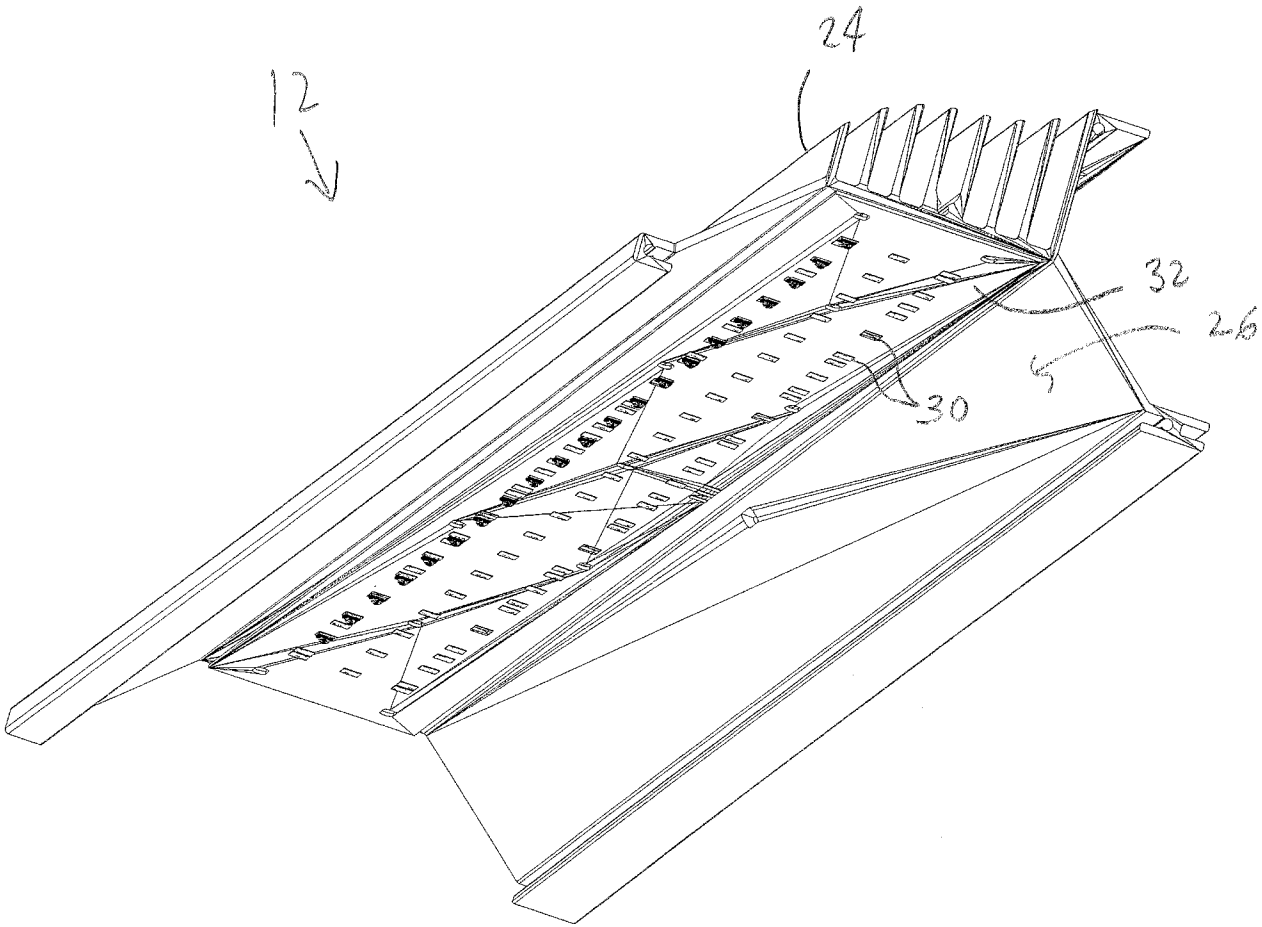
Figure 13:
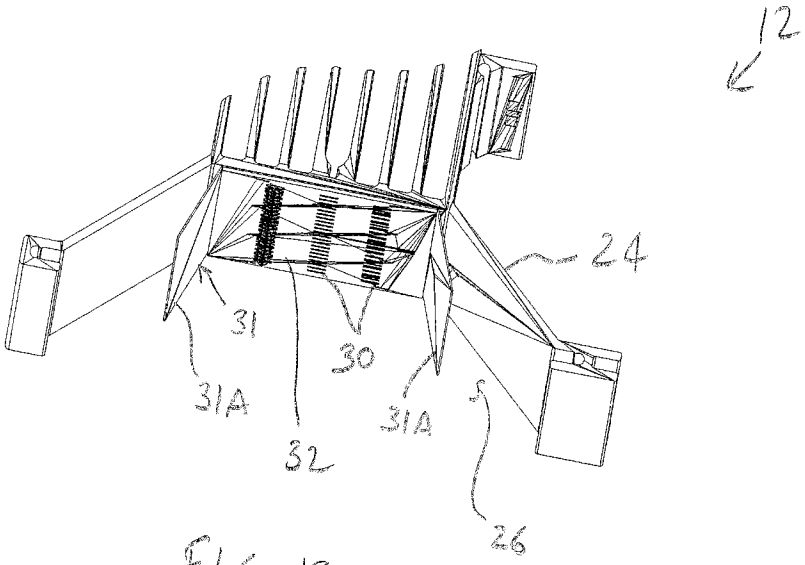

As shown in FIGS. 11-13, a plurality of solid state lighting elements 30 is disposed within each of the open channels 26. The solid state lighting elements 30 may be provided mounted directly to the body 24 and/or may be provided as an integrated circuit with a board 32 (such as a PCB (printed circuit board)). The solid state lighting elements 30 may be mounted and electrically coupled in any known manner. The board 32 in turn may be mounted to the body 24. The solid state lighting elements 30 may be of any form, including, but not limited to, LED (light emitting diode), OLED (organic light emitting diode) and/or PLED (polymeric light emitting diode) form. Optionally, a reflector 31 may be provided within one or more of the open channels 26 having one or more panels 31A configured to reflect, and, thus, direct, light emitted from the solid state lighting elements 30. The reflector(s) 31 may be located at least partially between the solid state lighting elements 30 or the board 32, and the body 24.

Figure 8:
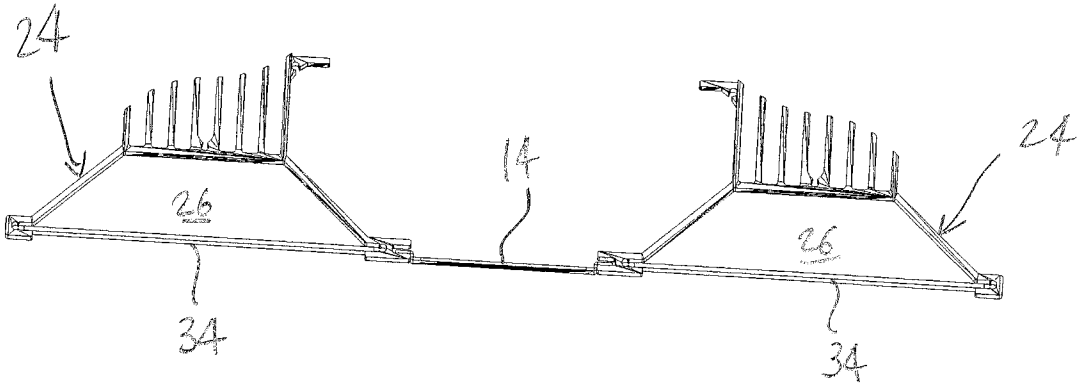
FIGS. 8-9 show the assembly of FIGS. 6-7 with a lens or diffuser mounted to each body.
Figure 9:
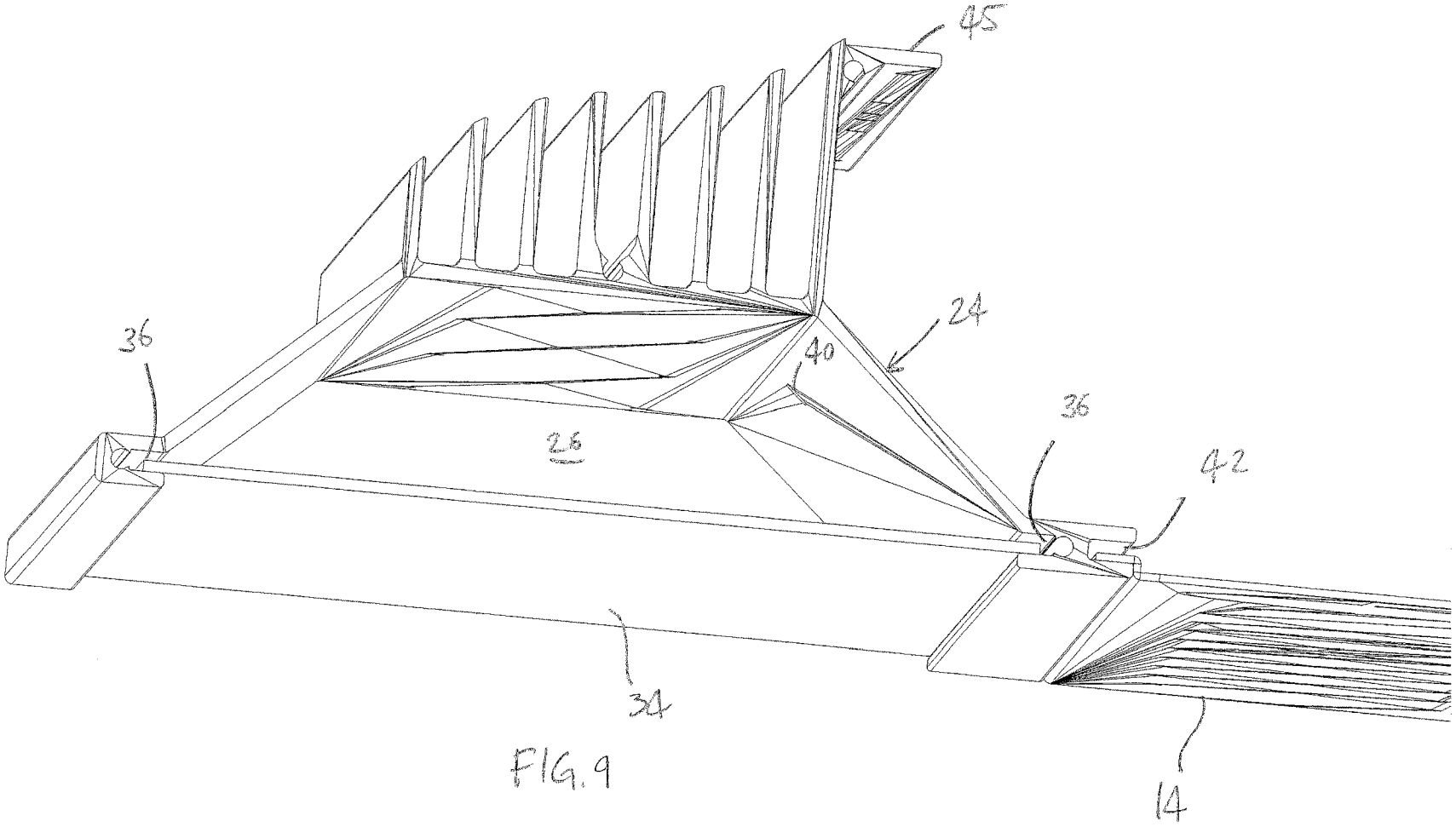
Figure 10:
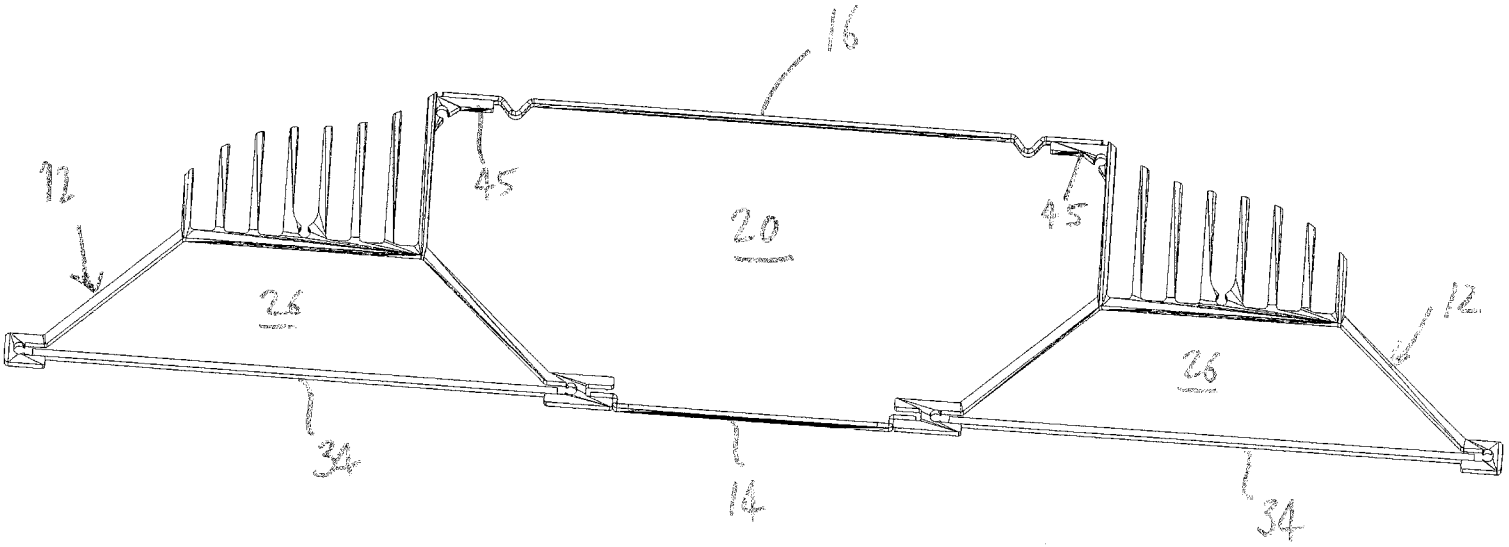
FIG. 10 shows the assembly of FIGS. 8-9 with an upper plate extending between the bodies.

As shown in FIGS. 8-10, a lens or diffuser 34 is provided for each of the lighting modules 12 formed to at least partly overlie the open channel 26 so that generated light passes therethrough. The lens or diffuser 34 may be formed with various levels of opacity so as to allow for different levels of light to pass through. The lens or diffuser 34 may be also configured to allow for spread-out or focused light distribution, as is known in the art.

Preferably, the lens or diffuser 34 overlies the entirety of the open channel 26. The body 24 may be provided with mounting channels 36 extending along edges of the open channel 26. The lens or diffuser 34 may be mounted to the body 24 with insertion into the mounting channels 36. This arrangement provides for edge mounting of the lens or diffuser 34.

The bottom plate 14 is provided to extend between, and be in contiguous contact with, a pair of the lighting modules 12. Preferably, the bottom plate 14 is positioned to be generally coplanar with at least one of the lens or diffuser 34 of an adjacent of the lighting modules 12. More preferably, the bottom plate 14 is positioned to be generally coplanar with the lens or diffuser 34 of both of the adjacent lighting modules 12. In this manner, the lighting fixture 10 is provided with a generally flat bottom appearance.

As shown in FIG. 10, the upper plate 16 is provided to extend between, and be in contiguous contact with, a pair of the lighting modules 12, with the upper plate 16 being spaced from the bottom plate 14. The upper plate 16 at least partially overlies the bottom plate 14 so as to bound opposite sides of the chamber 20.

Figure 14:
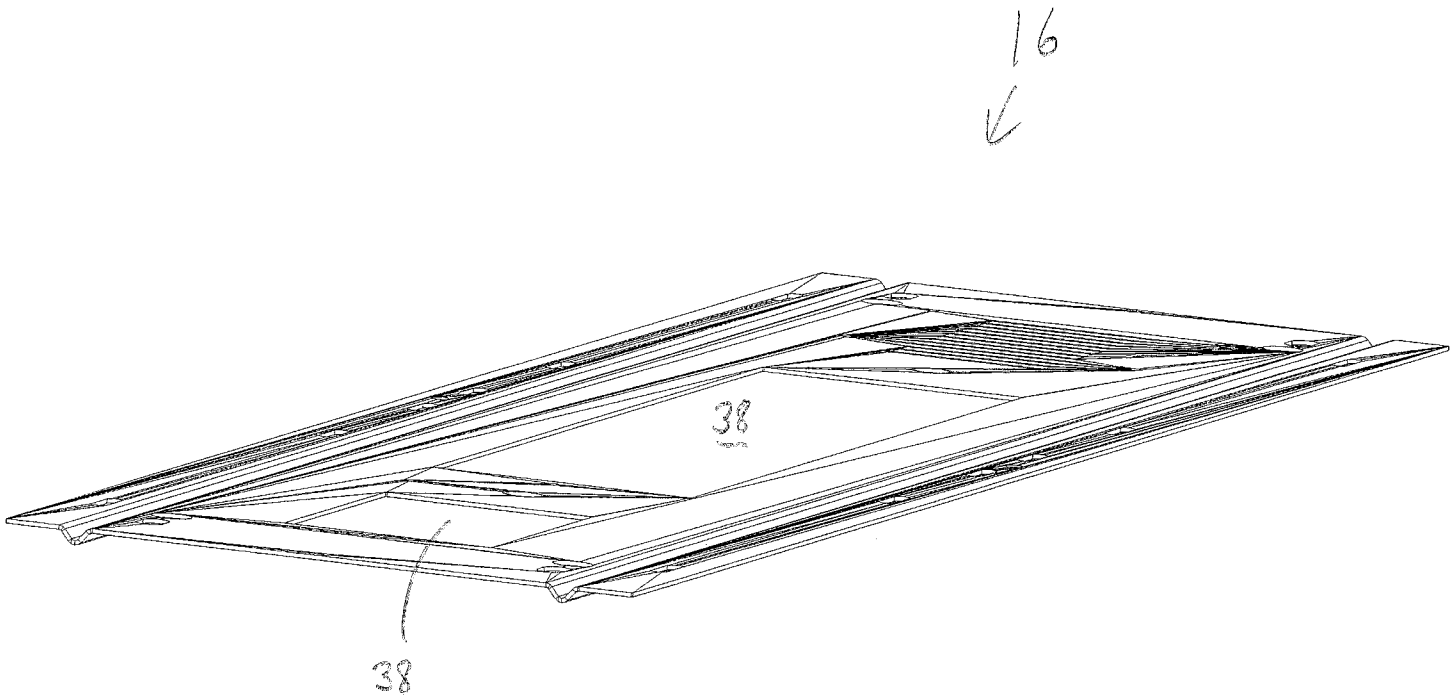
FIGS. 14-15 show an upper plate in accordance with the subject invention.
Figure 16:
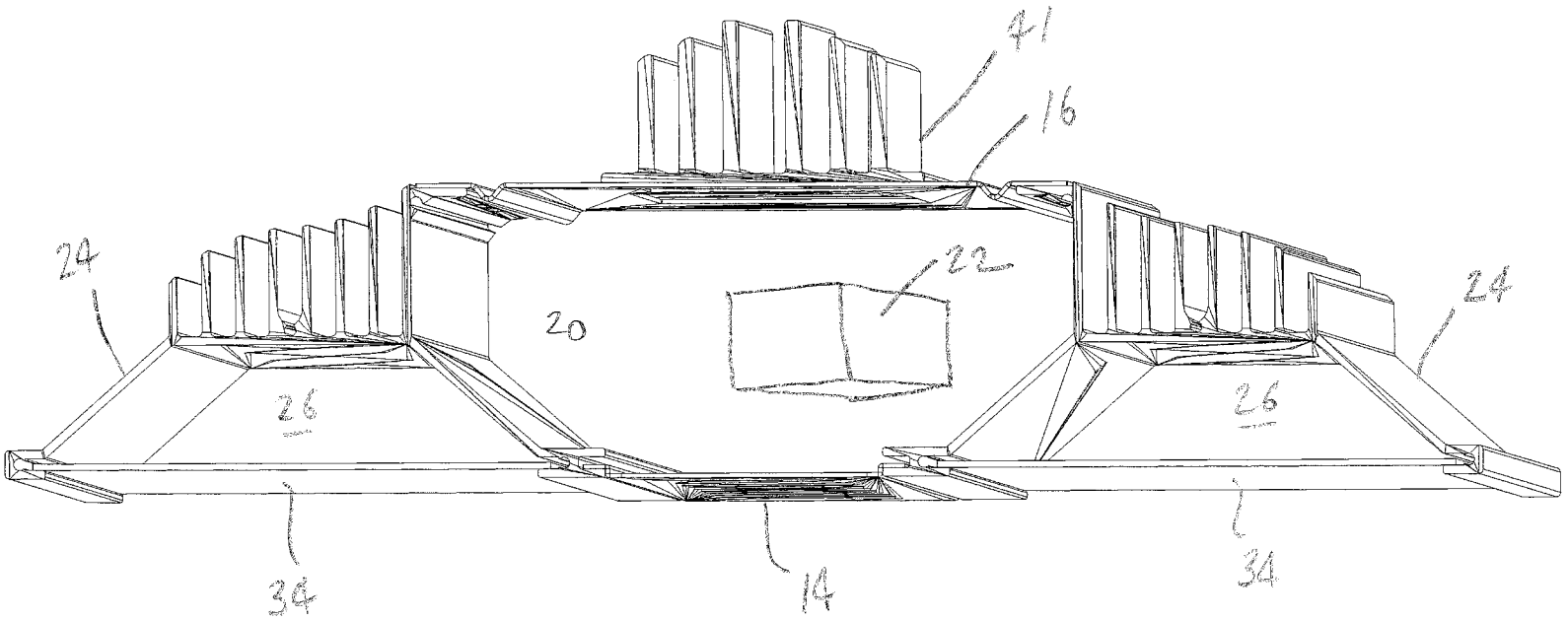
FIG. 16 show an assembly in accordance with the subject invention.
Figure 17:
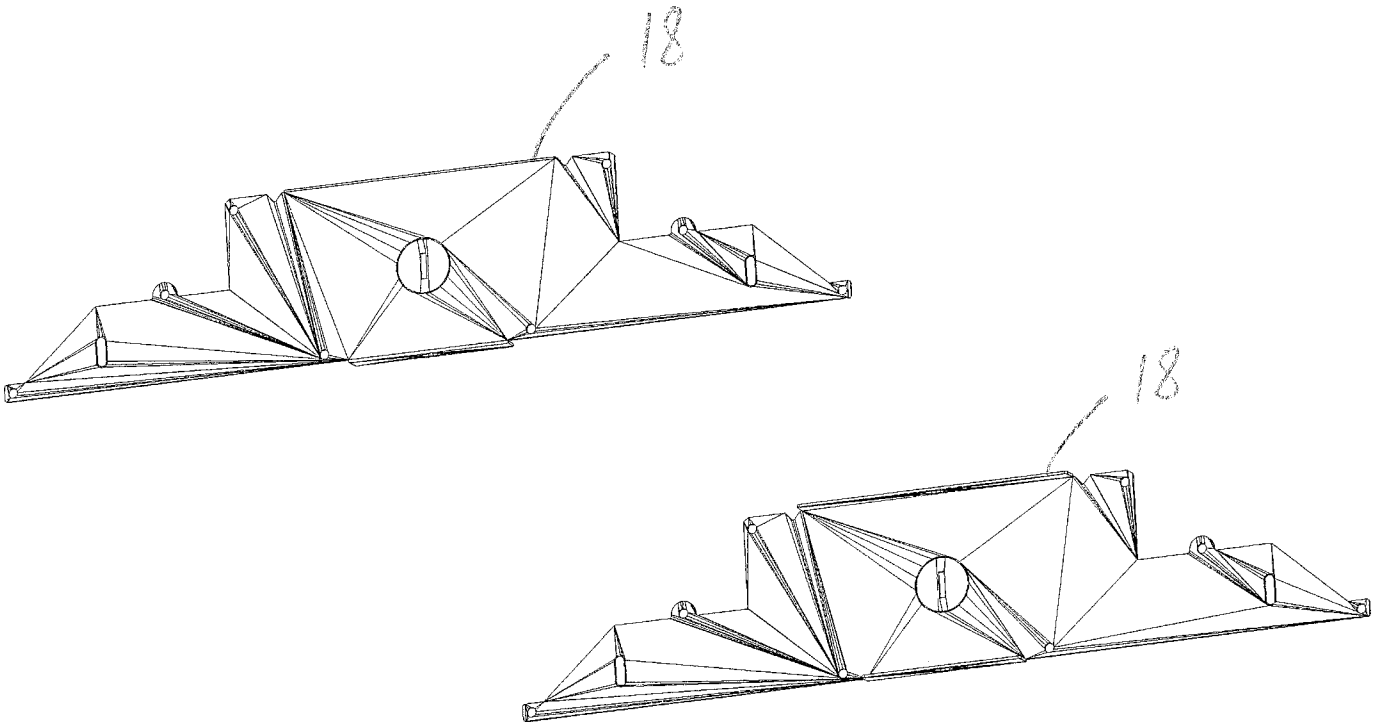
FIG. 17 shows a pair of endcaps in accordance with the subject invention.

Electronic components, including electrical power components, such as the driver 22 configured to convert alternating current into direct current, may be accommodated within the chamber 20 (FIG. 16). One or more openings 38 (FIG. 14) may be provided in the upper plate 16 to provide access to the chamber 20, to allow for passage of electrical wiring (e.g., to provide electrical power), to allow for venting, and/or to accommodate control elements. One or more sensors 39 (FIG. 2) may be provided external to the chamber 20, such as mounted to the bottom plate 14, to detect daylight or motion with the sensors 39 being electrically coupled through the bottom plate 14. One or more access holes 40 (FIG. 5) may be provided in the bodies 24 to allow for electrically coupling of the solid state lighting elements 30 with the driver 22 and any other electrical components in the chamber 20 as needed. Power is provided to the lighting fixture 10 in any known manner, including with standard alternating current, with wiring being provided to convey such electrical power into the chamber 20. Reference herein to "lens" or "diffuser" alone is understood to cover both.

Figure 15:
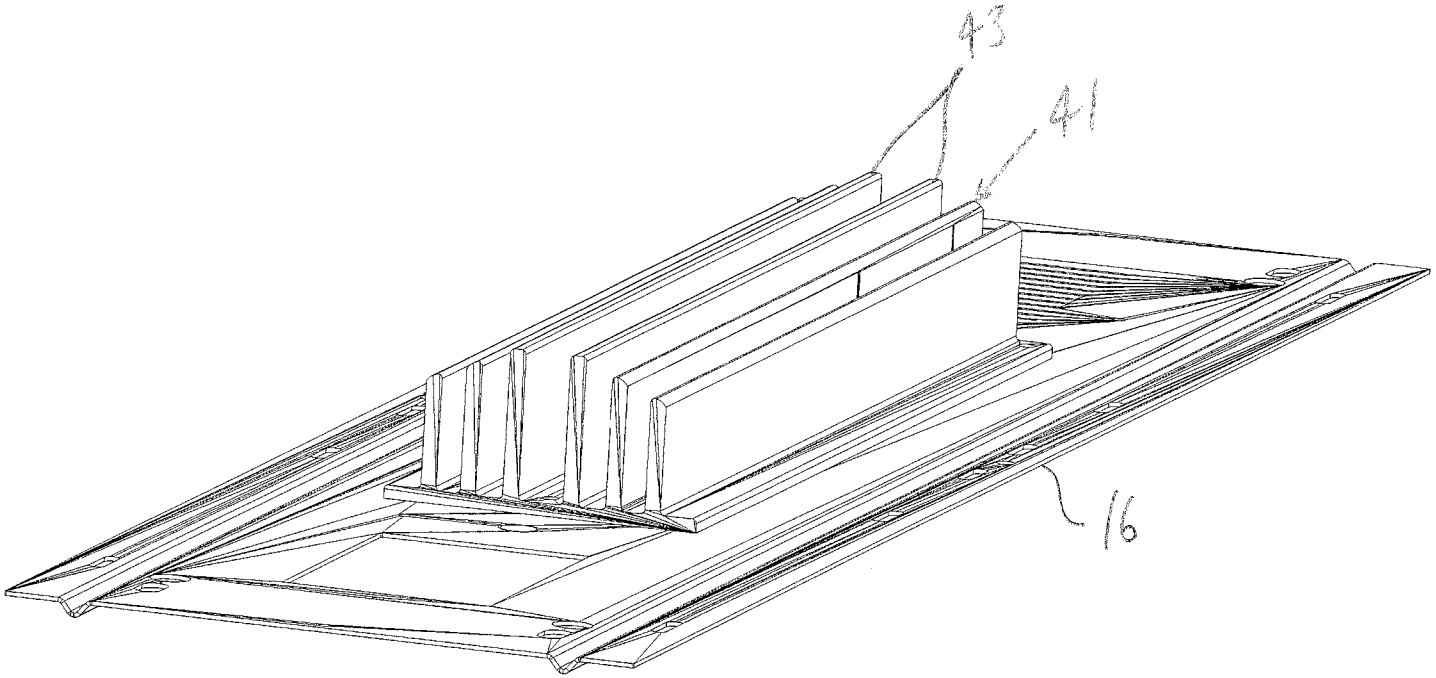

One or more heatsinks 41 (FIGS. 15-16) may be mounted to the upper plate 16, e.g., through one or more of the openings 38, to dissipate heat generated within the chamber 20. The heatsink(s) 41 may be provided with fins 43 or other protruding structures which enhance the dissipation of heat. Preferably, the heatsink(s) 41 are preferably formed of a material having good heat conductivity properties, such as metal (e.g., aluminum).

Figure 7:
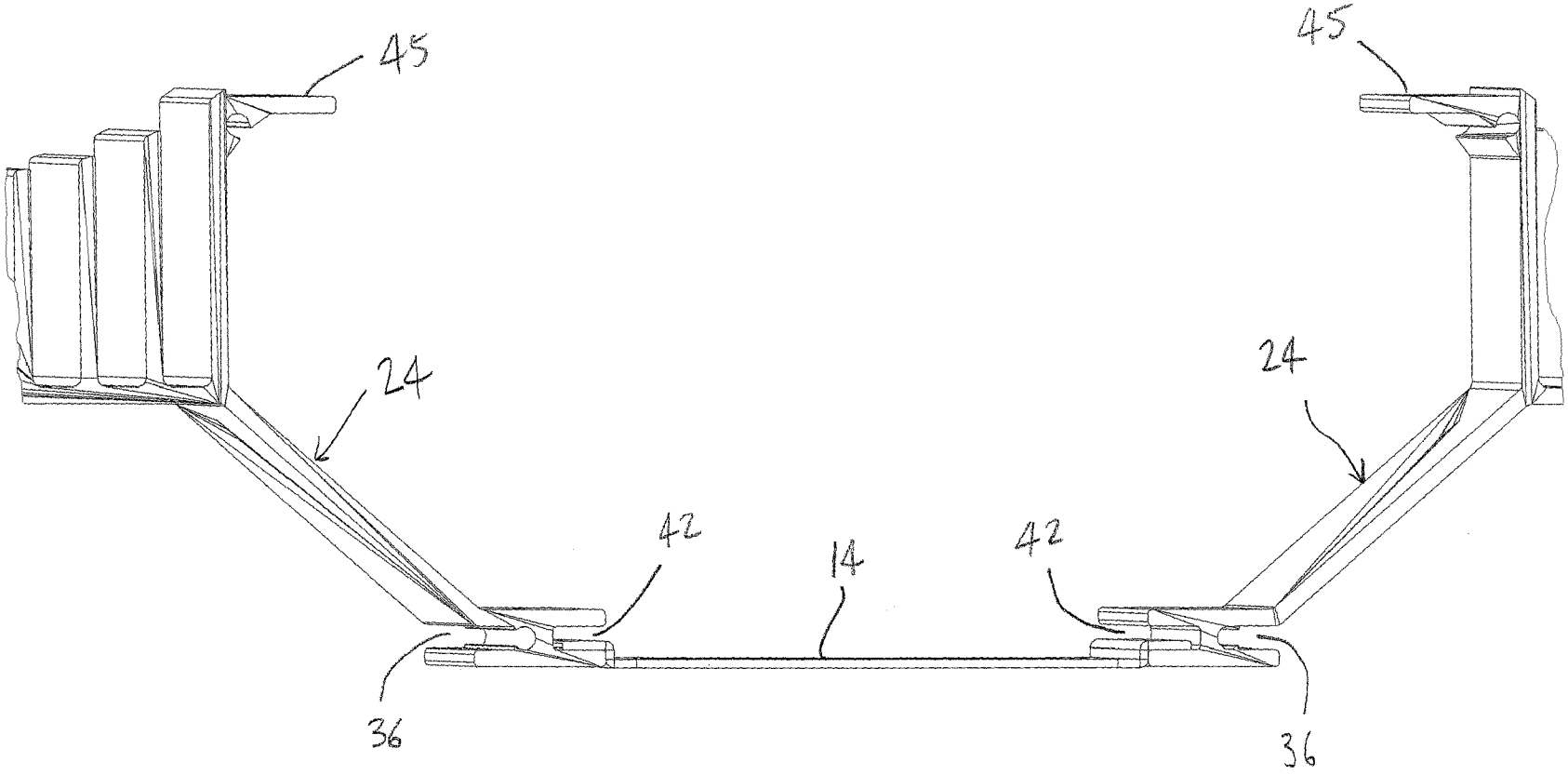
Figure 18:
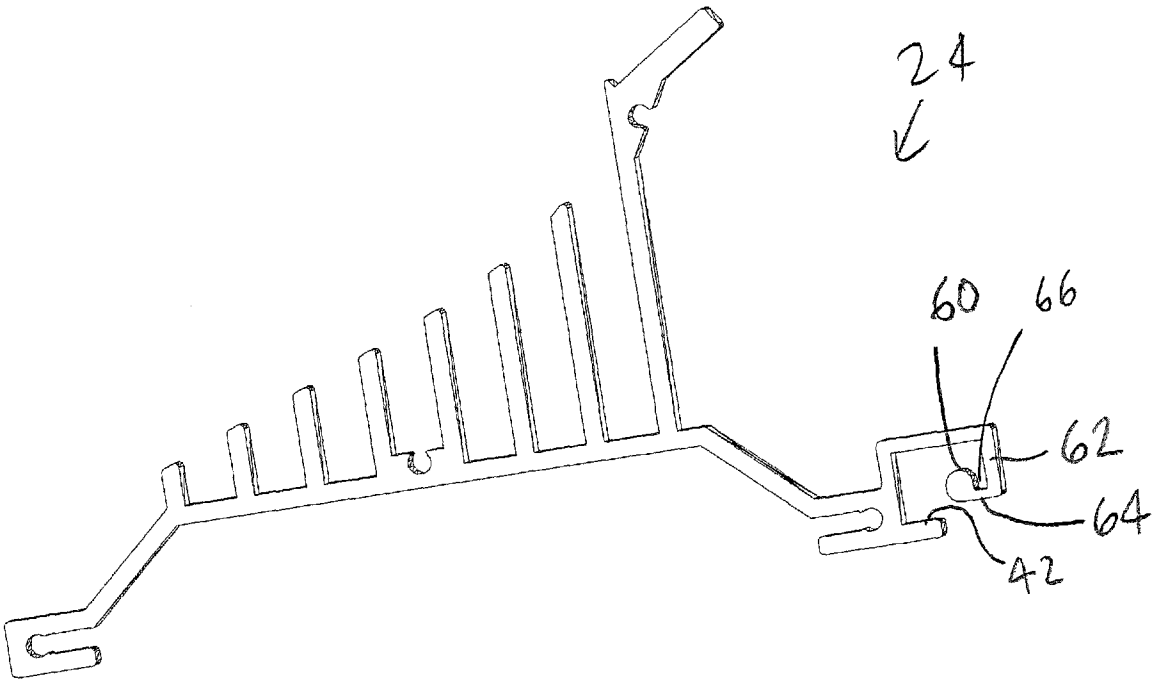
FIGS. 18-19 show a hinged mounting arrangement for the bottom plate in accordance with the subject invention; and, FIG. 20 shows a unitary construct of the upper plate and the endcaps in accordance with the subject invention.
Figure 19:
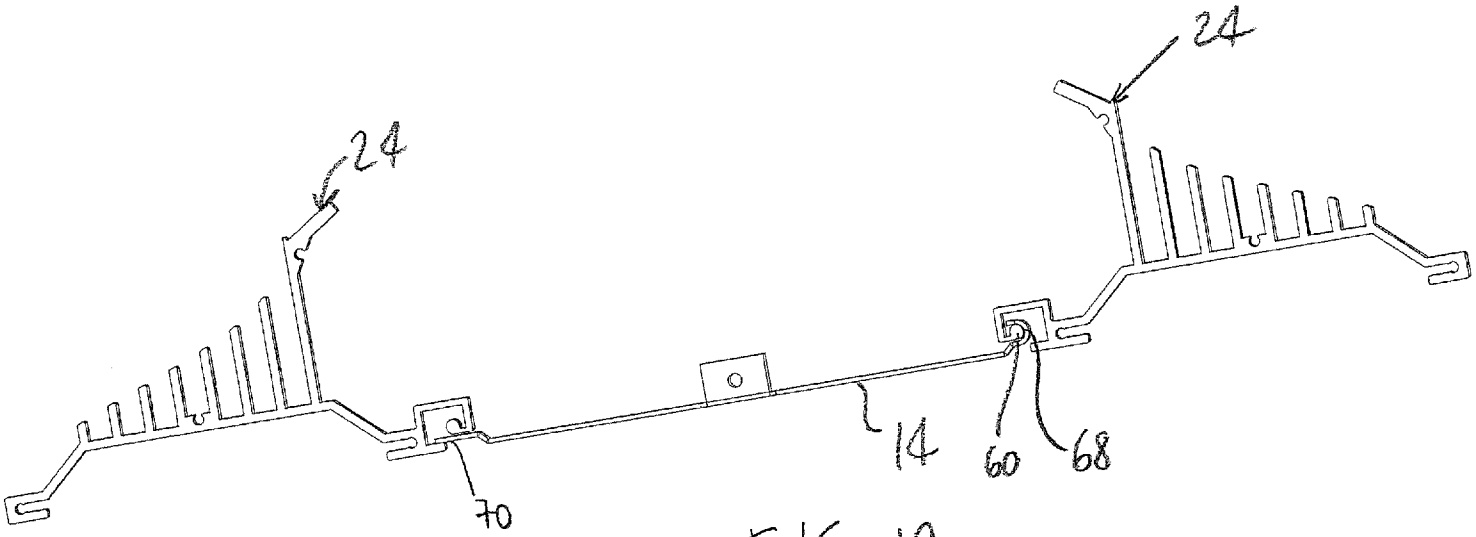

The bottom plate 14 and the upper plate 16 may be mounted to the lighting modules 12 in any manner. Secondary mounting channels 42 (FIG. 7) may be provided on the bodies 24 of the lighting modules 12 adjacent to the bottom plate 14 so as to edge support the bottom plate 14 therebetween. With reference to FIG. 18, the secondary mounting channels 42 may be each provided with a bead 60, e.g., on a downwardly extending wall 62 positioned to partially extend across the respective secondary mounting channel 42. A secondary wall 64 may extend inwardly from the wall 62 with the bead 60 being located on the secondary wall 64. A gap 66 may be provided between the bead 60 and the wall 62 to act as clearance. As shown in FIG. 19, the bottom plate 14 may be provided with a curved edge 68 formed to resiliently engage one of the beads 60 in providing a rotatable connection for the bottom plate 14 relative to the body 24 in the manner of a hinged connection. Opposing edge 70 of the bottom plate 14 may be received in the opposite secondary mounting channel 42 with the bead 60 thereof applying a resilient holding force. The opposing edge 70 may be raised or indented. With release of the opposing edge 70, the bottom plate 14 may be hingedly rotated using the curved edge 68 to gain access to the chamber 20. This configuration allows for the bottom plate 14 to be suspended in an open state without need for removal with return to a closed state when necessary. The upper plate 16 may be screw mounted, edge mounted, etc. to the bodies 24. Mounting features, such as ledges 45, may be provided on the bodies 24 for securing to the upper plate 16.

Figure 20:
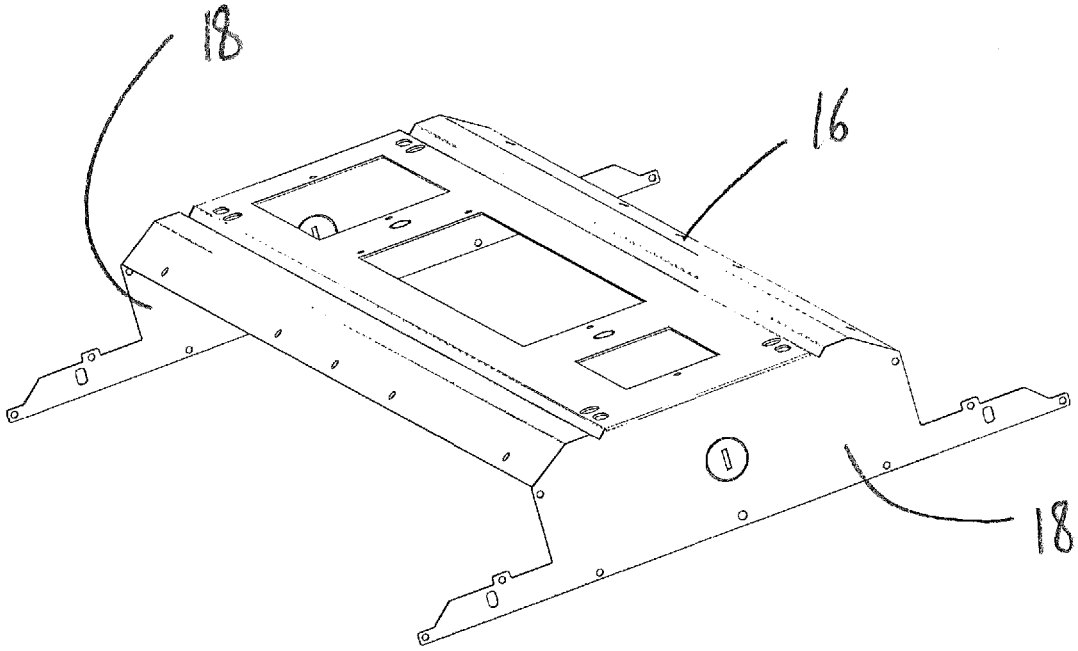

To provide the lighting fixture 10 with a closed appearance, the endcaps 18 are provided to extend across opposing ends of the lighting fixture 10. The endcaps 18 may be secured in any known manner, including being screw mounted, e.g., to the lighting modules 12. Preferably, the endcaps 18 at least partially overlie the open channels 26 and the chamber(s) 20. Also, preferably, the endcaps 18 at least partially overlie the bottom plate 14 and the upper plate 16. The open channels 26 are preferably fully enclosed by the endcaps 18 and the respective lens or diffusers 34. As shown in FIG. 20, the upper plate 16 may be formed unitary with one or both of the endcaps 18.

A guard 44, which may be a wire guard, may be utilized to provide at least some level of protection for the lighting fixture 10, particularly with respect to the light generating side of the lighting fixture 10.

As will be appreciated by those skilled in the art, the lighting fixture 10 may be scaled to larger sizes with the addition of lighting modules 12, e.g., more than two of the lighting modules 12. The addition of lighting modules results in the use of additional bottom plates and upper plates. Interiorly located lighting modules may be adapted to have mounting channels along both edges of the respective open channel to permit edge mounting on both sides of bottom plates. The addition of lighting modules also results in additional chambers. Electrical components may be provided in the chamber(s) as needed for the lighting fixture. It may be that single components, such as a single sensor or driver, are provided, even with two or more chambers. The chambers do not need to be equipped equally.

In addition, the lighting fixture 10 may be scaled to various sizes with the use of generally constant cross-section bodies 24 for the lighting modules 12 which allows for long extrusions being formed and cut to length as required. Likewise, the bottom plate 14 and the upper plate 16 may be cut to length as required. The lighting fixture 10 may be scaled in both length and width based on the number of lighting modules 12 and the length thereof.

The lighting fixture 10 may be mounted in any known manner including by suspension cables 46 and/or posts 48 which are secured to the lighting fixture 10 through mounting holes, brackets and other known manners.

What is claimed is:

1. A modular solid state high-bay lighting fixture comprising:

first and second bodies, each said body defining an open channel along one face;

a plurality of solid state light generating elements disposed within said open channels of said first and second bodies;

a first lens extending across said open channel of said first body;

a second lens extending across said open channel of said second body, said second lens being spaced from said first lens;

a bottom plate extending between, and in contiguous contact with, said first and second bodies; and, an upper plate extending between, and in contiguous contact with, said first and second bodies, wherein said upper plate being spaced from, and at least partial overlying, said bottom plate so as to partially define a chamber between said first and second bodies.

2. A lighting fixture is in claim 1, further comprising first and second endcaps formed to enclose therebetween said first and second bodies, said bottom plate and said upper plate.

3. A lighting fixture as in claim 2, wherein said upper plate is unitarily formed with said first and second endcaps.

4. A lighting fixture as in claim 1, wherein said first and second bodies have the same cross-section.

5. A lighting fixture as in claim 1, wherein said first and second bodies each have a generally constant cross-section throughout the respective length thereof.

6. A lighting fixture as in claim 1, wherein said first and second bodies are each provided with a plurality of protruding fins opposite said respective open channel.

7. A lighting fixture as in claim 1, wherein a reflector is provided in at least said open channel of said first body, said reflector having one or more panels configured to reflect light emitted by said solid state light generating elements.

8. A lighting fixture as in claim 1, wherein said first body is provided with mounting channels along edges of said open channel, said first lens being mounted to said first body with insertion into said mounting channels.

9. A lighting fixture as in claim 1, wherein said first and second bodies are each provided with a secondary mounting channel, said bottom panel being edge supported by said secondary mounting channels.

10. A lighting fixture as in claim 9, wherein said secondary mounting channels are each provided with a bead, said bottom panel having a curved edge formed to resiliently engage one of said beads to provide a rotatable connection therewith.

11. A lighting fixture as in claim 1, wherein said bottom plate is generally coplanar with said first lens.

12. A lighting fixture as in claim 11, wherein said second lens is generally coplanar with said first lens.

13. A lighting fixture as in claim 1, wherein said first and second bodies are each provided with a ledge, said upper plate being secured to said ledges.

14. A lighting fixture as in claim 1, further comprising a driver accommodated in said chamber, said driver being electrically coupled with said solid state light generating elements.

* * * * *